US006058919A

United States Patent [19]

Davis

[11] Patent Number: 6,058,919

[45] Date of Patent: May 9, 2000

[54] HUNTING BOW DRAW GUIDE

[76] Inventor: Mitchell G. Davis, 638 Wickham Ave., Princeton, W. Va. 24740

[21] Appl. No.: 09/334,898

[22] Filed: Jun. 17, 1999

[51] Int. Cl.[7] ..... F41B 5/22

[52] U.S. Cl. ..... 124/24.1; 124/44.5

[58] Field of Search ..... 124/24.1, 44.5

[56] References Cited

U.S. PATENT DOCUMENTS

| | | | |
|---|---|---|---|
| 4,838,237 | 6/1989 | Cliburn | 124/44.5 |
| 5,025,773 | 6/1991 | Hintze et al. | 124/44.5 |
| 5,285,764 | 2/1994 | Mertens | 124/44.5 |
| 5,490,492 | 2/1996 | Savage | 124/44.5 |
| 5,555,875 | 9/1996 | Martin et al. | 124/44.5 |

*Primary Examiner*—John A. Ricci

[57] ABSTRACT

A draw guide for a hunting bow is disclosed. Guide members are interposed between the bow and the string in order to support the arrow during the shooting process and to permit the string to pass therethrough during the aforementioned process. In this manner, the arrow is supported by the guide members during the shooting process while the string is permitted to pass therethrough thus allowing shorter arrows to be utilized.

4 Claims, 2 Drawing Sheets

HUNTING BOW DRAW GUIDE

TECHNICAL FIELD

The present invention relates to a hunting bow, in general, and, more particularly, to a draw guide attachment for a hunting bow permitting the bow to be used with shorter arrows.

BACKGROUND ART

The use of relatively short arrows by a bow hunter or a tournament archery enthusiast provides a number of advantages. For example, the use of a shorter arrow results in the arrow having more velocity than a longer arrow. Also, shorter arrows have greater accuracy than longer arrows. In addition, shorter arrows can be more easily carried through brush and thickets than longer arrows. Thus, there are a number of advantages of using shorter arrows in hunting or in tournament archery competition.

The use of shorter arrows requires some type of arrow guide to support the arrow during the shooting process and to permit the passage of the string therethrough during the aforementioned process. Ideally, the guide would be positioned between the string and the body of the bow, thus allowing shorter arrows to be used. Such guides are not presently available.

If view of the foregoing, it has become desirable to develop a guide for a bow which permits the use of shorter arrows thus increasing the velocity of the arrows and improving the accuracy of the shooting process.

SUMMARY OF THE INVENTION

The present invention is directed to an arrow guide which mounts to the body of the bow and which includes guides that are interposed between the bow and the string. In this manner, the guides support the arrow during the shooting process and permit the string to pass therethrough during the aforementioned process. Thus, since the guides are interposed between the bow and the string, a shorter arrow can be utilized.

DESCRIPTION OF THE PREFERRED EMBODIMENT

Figure 1:
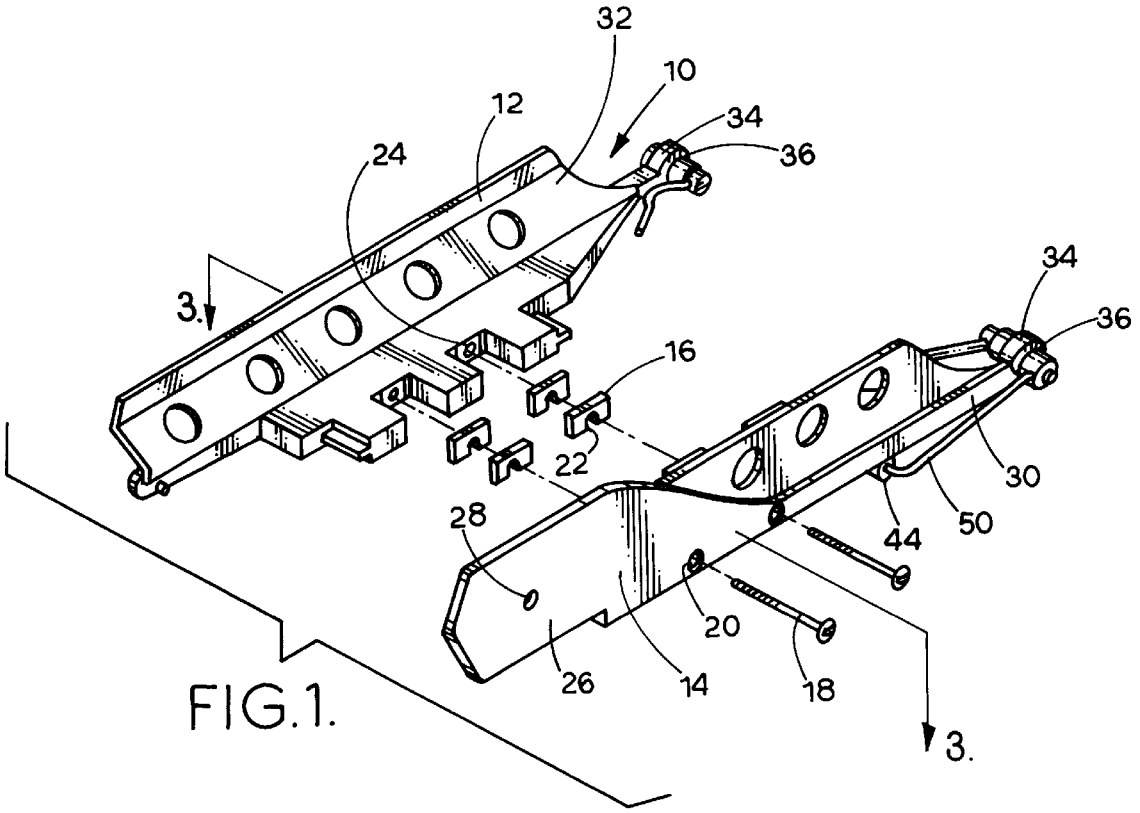
FIG. 1 is an exploded perspective view of the present invention.
Figure 2:
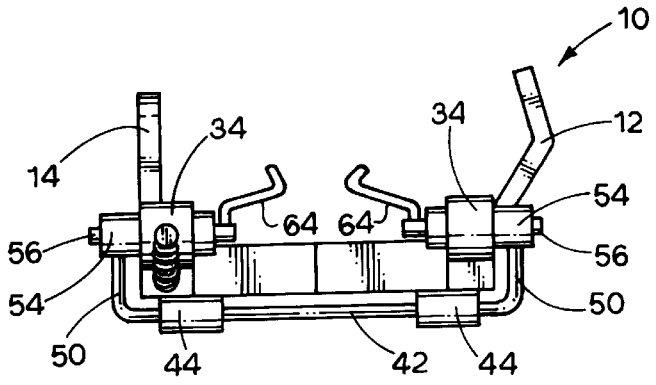
FIG. 2 is a rear view of the present invention.
Figure 3:
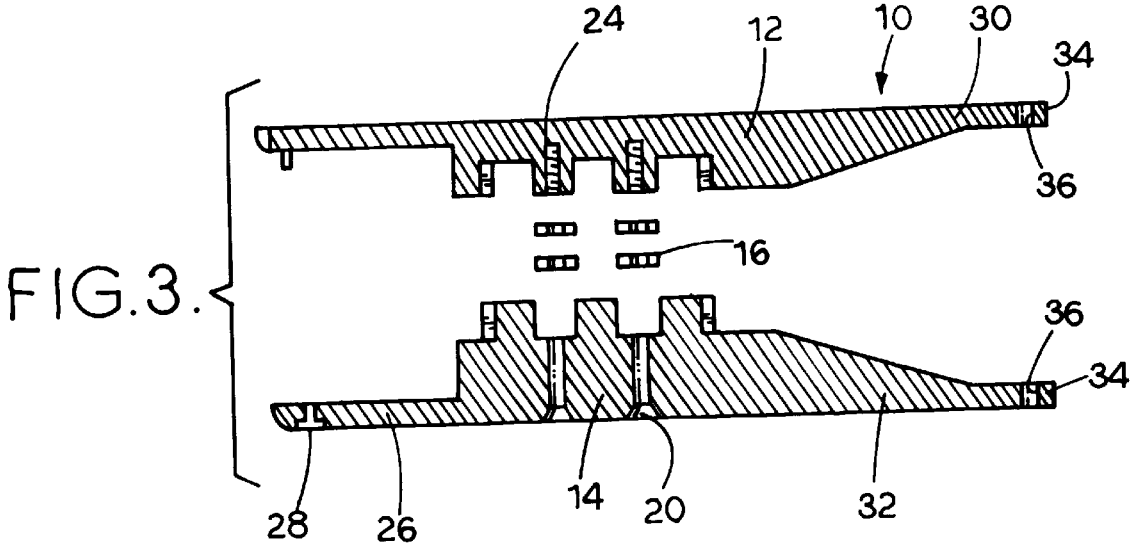
FIG. 3 is a cross-sectional view of the present invention taken across section-indicating lines 3—3 in FIG. 1.

Referring now to the drawings where the illustrations are for the purpose of describing the preferred embodiment of the present invention and are not intended to limit the invention described herein, FIG. 1 is an exploded perspective view of the arrow guide 10 of the present invention. The arrow guide 10 is comprised of a first base portion 12, a second base portion 14, a plurality of shims 16 which are interposed between the first and second base portions 12 and 14, and a plurality of fasteners 18 which are received through apertures 20 in second base portion 14 and recesses 22 in shims 16 and threadingly engage threaded bores 24 in first base portion 12.

Figure 4:
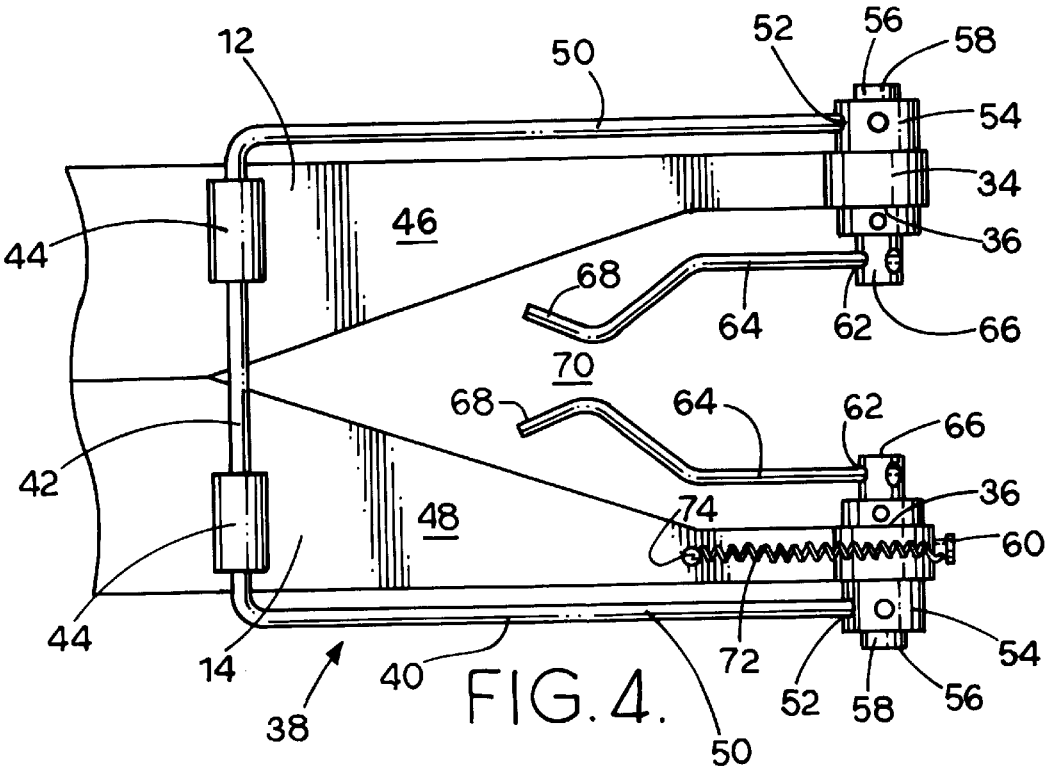
FIG. 4 is a bottom plan view of the present invention.

End 26 of second base portion 14 is provided with an aperture 28 permitting the mounting of the arrow guide 10 to the center section of a bow (not shown). Opposite end 30 of second base portion 14 and oppositely disposed end 32 of first base portion 12 are provided with generally circular hubs 34, each having a bore 36 therethrough. A guide arrangement 38, as shown in FIG. 4, is provided and is comprised of a U-shaped yoke 40 having a first yoke portion 42 with bumpers 44 thereon which rests against the bottom surfaces 46 and 48 of first and second base portions 12 and 14, respectively, and oppositely disposed arms 50 whose respective ends 52 are each received within a cylindrical sleeve 54 received through bore 36 in hub 34 in each of the first and said second base portions 12 and 14. A cylindrical pin 56 is received through each of the sleeves 54 and the end 58 of each pin 56 is attached to its respective sleeve 54 by a fastener 60. One end 62 of each oppositely disposed guide member 64 is press fit into the opposite end 66 of each pin 56. The opposite ends 68 of guide members 64 are configured and positioned so that a gap 70 exists therebetween. A spring 72 is provided and is attached at one end thereof to fastener 60 within sleeve 54 in hub 34 of second base portion 14 and is attached at the other end thereof to a fastener 74 received within the bottom surface 48 of second base portion 14. The spring 72 generally encircles the sleeve 54 and biases the guide members 64 so that they are normally oriented slightly upwardly with respect to the longitudinal axis of the arrow guide 10.

In operation, an arrow (not shown) is positioned so that its shaft portion rests on the top surface of the guide members 64 and is supported thereon. When the string is drawn back and subsequently released, the string passes through the gap 70 between the guide members 64 causing the arrow to be projected towards the target. The guide members 64 are then depressed slightly downwardly so as to be substantially parallel to the longitudinal axis of the arrow guide 10 causing the first yoke portion 42 with the bumpers 44 thereon to be biased against the bottom surfaces 46 and 48 of first and second base portions 12 and 14, respectively. The string then returns through the gap 70 between the guide members 64 to a resting position exteriorly of the arrow guide 10 and the guide members 64 return to their normal position of being oriented slightly upwardly with respect to the longitudinal axis of the arrow guide 10.

Certain modifications and improvements will be apparent to those skilled in the art upon reading the foregoing. It is understood that such modifications and improvements have been deleted herein for the sake of conciseness and readability, but are properly within the scope of the following claims.

I claim:

1. A hunting bow draw guide comprising a base member attachable to a hunting bow, said base member comprising a first base member and a second base member operatively attached together, shim members interposed between said first base member and said second base member permitting the width of said base member to be adjusted, a guide assembly rotatably attached to said base member, and means for biasing said guide assembly so that a portion thereof normally contacts said base member when the draw guide is in use.

2. The draw guide as defined in claim 1 wherein said guide assembly is rotatably attached to said base member at one end of said base member.

3. The draw guide as defined in claim 2 wherein the opposite end of said base member is attachable to the hunting bow.

4. The draw guide as defined in claim 1 wherein said guide assembly is comprised of oppositely disposed longitudinally extending guide members.

* * * * *